US009243314B2

(12) United States Patent
Sukawa et al.

(10) Patent No.: US 9,243,314 B2
(45) Date of Patent: Jan. 26, 2016

(54) METHOD FOR MANUFACTURING HIGH-SI AUSTENITIC STAINLESS STEEL

(75) Inventors: Tomoyuki Sukawa, Joetsu (JP); Shinnya Yamamoto, Wakayama (JP); Kouichi Takeuchi, Chofu (JP); Hayato Kita, Joetsu (JP); Shuuji Yoshida, Joetsu (JP); Katsuhiko Taketsu, Joetsu (JP); Masayuki Shibuya, Narashino (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 14/235,873

(22) PCT Filed: Jul. 26, 2012

(86) PCT No.: PCT/JP2012/068906

§ 371 (c)(1),
(2), (4) Date: Apr. 21, 2014

(87) PCT Pub. No.: WO2013/018629

PCT Pub. Date: Feb. 7, 2013

(65) Prior Publication Data

US 2014/0294659 A1 Oct. 2, 2014

(30) Foreign Application Priority Data

Jul. 29, 2011 (JP) ..... 2011-166365

(51) Int. Cl.

| | |
|---|---|
| ***C22C 38/48*** | (2006.01) |
| ***C22C 38/04*** | (2006.01) |
| ***C22C 38/00*** | (2006.01) |
| ***C22C 38/06*** | (2006.01) |
| ***C22C 38/34*** | (2006.01) |
| ***C22C 38/58*** | (2006.01) |

(52) U.S. Cl.

CPC ..... *C22C 38/48* (2013.01); *C22C 38/001* (2013.01); *C22C 38/04* (2013.01); *C22C 38/06* (2013.01); *C22C 38/34* (2013.01); *C22C 38/58* (2013.01)

(58) Field of Classification Search

CPC ..... C22C 38/48; C22C 38/34; C22C 38/06; C22C 38/04; C22C 38/001

See application file for complete search history.

(56) References Cited

U.S. PATENT DOCUMENTS

2012/0237388 A1* 9/2012 Sawada ..... 420/49

FOREIGN PATENT DOCUMENTS

| | | |
|---|---|---|
| EP | 1352980 | 10/2003 |
| JP | 1119398 | 2/1982 |
| JP | 57-037669 | 8/1982 |
| JP | 62-290848 | 12/1987 |
| JP | 04-202628 | 7/1992 |
| JP | 05-051633 | 3/1993 |

(Continued)

*Primary Examiner* — Rebecca Lee
(74) *Attorney, Agent, or Firm* — Clark & Brody

(57) ABSTRACT

A high-Si content austenitic stainless steel, which exhibits stable acid resistance and excellent corrosion resistance in high-temperature and concentrated nitric acid, has a chemical composition comprising: C: at most 0.04%; Si: 2.5-7.0%; Mn: at most 10%; P at most 0.03%; S: at most 0.03%; N: at most 0.035%; sol. Al: at most 0.03%; Cr: 7-20%; Ni: 10-22%; optionally, one or more types selected from Nb, Ti, Ta and Zr: 0.05-0.7% in total; and the remainder being Fe and impurities, wherein a total amount of $B_1$ type inclusions measured by a method according to JIS G0555 (2003) Annex 1 "Microscopic Testing for the Non-Metallic Inclusions on the Point Counting Principle" is not more than 0.03% by area %.

2 Claims, 1 Drawing Sheet

(56) References Cited

FOREIGN PATENT DOCUMENTS

| | | |
|---|---|---|
| JP | 5-287460 | 11/1993 |
| JP | 6-256911 | 9/1994 |
| JP | 06-306548 | 11/1994 |
| JP | 8-144020 | 6/1996 |
| JP | 3237132 | 12/2001 |
| JP | 4025170 | 10/2007 |
| KR | 2001-037816 | 5/2001 |
| WO | WO 2011062152 A1 * | 5/2011 |

* cited by examiner

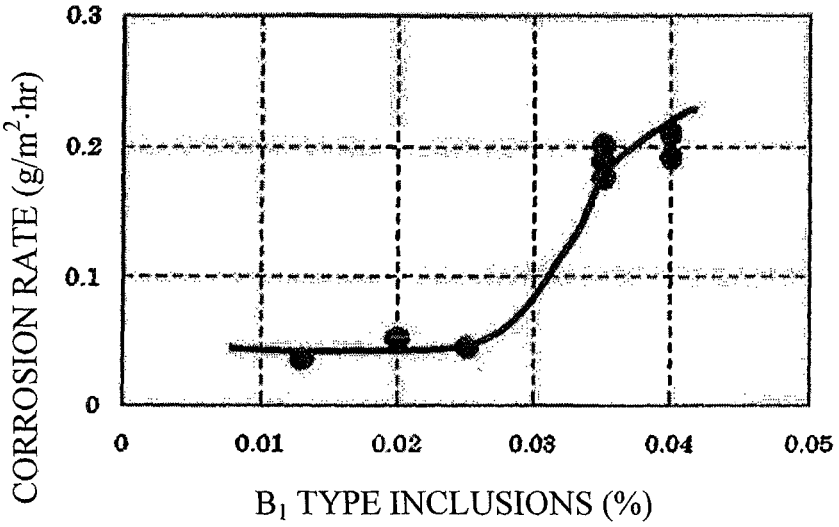
0.3
0.2
0.1
0
CORROSION RATE (g/m²·hr)
0
0.01
0.02
0.03
0.04
0.05
B1 TYPE INCLUSIONS (%)

METHOD FOR MANUFACTURING HIGH-SI AUSTENITIC STAINLESS STEEL

TECHNICAL FIELD

The present invention relates to a method for manufacturing a high-Si austenitic stainless steel which is suitable for use in a high temperature and concentrated nitric acid environment.

BACKGROUND ART

Stainless steel forms a stable passive film in nitric acid thereby exhibiting excellent corrosion resistance. However, high-temperature and concentrated nitric acid, for example, a temperature of 80 to 90° C. and a concentration of 90% by mass, has an extremely strong oxidizing power and causes transpassive corrosion in general stainless steels. Further, transpassive corrosion facilitates general corrosion in whole, which involves dissolution of $Cr_2O_3$ which forms a passive film.

An example of materials having corrosion resistance in this type of environment includes high-Si austenitic stainless steels disclosed by Patent Documents 1 and 2. These high-Si austenitic stainless steels have excellent nitric acid corrosion resistance due to formation of a silicate ($SiO_2$) film in a transpassive region.

However, regarding acid resistance, although no serious problem has occurred, there are cases where corrosion is excessively facilitated, the causes of which are unclear in many respects, and a solution for such cases is needed.

Moreover, in a high-Si austenitic stainless steel, because of a concentration of Si, a large amount of inclusions and intermetallic compounds are formed in steel, causing deterioration of hot workability. To solve this problem, Patent Document 3 discloses that hot workability is improved by limiting the chemical composition such that Al is 0.05% or less ("%" regarding chemical composition means "mass %" unless otherwise stated in the present description) and O is 0.003% or less, and by eliminating formed intermetallic compounds through hot rolling after performing soaking and/or temperature uniformity at 1100 to 1250° C. for long hours. The inclusions are limited in the total amount, and not limited in their types.

Although Patent Document 4 discloses defining an amount of sol. Al to prevent the production of oxides which deteriorate corrosion resistance in working-flow, it has given no consideration on inclusions produced in molten steel, and is silent on the deterioration of corrosion resistance caused by inclusions. Since in general, the amount of inclusions such as $Al_2O_3$ is not directly related to the amount of sol. Al, simply controlling the amount of sol. Al is not enough to prevent problems caused by inclusions.

Patent Document 5 discloses that corrosion resistance is improved by finely dispersing inclusions based on the idea that inclusions originally occurs corrosion. However, it only facilities fine dispersion of MnS by controlling the amount of S and hot rolling conditions, and discloses nothing on alumina inclusions and others.

Patent Document 6 discloses an invention to prevent pitting corrosion by making a cluster of inclusions granular to make the inclusions water insoluble through the control of the composition of the inclusions. However, such inclusions hinder the formation of a silicate film which is needed to improve corrosion resistance under high-temperature and concentrated nitric acid.

PATENT DOCUMENT

Patent Document 1: Japanese Patent No. 3237132

Patent Document 2: Japanese Patent No. 1119398

Patent Document 3: Japanese Patent Laid-Open No. 5-51633

Patent Document 4: Japanese Patent Laid-Open No. 6-306548

Patent Document 5: Japanese Patent Laid-Open No. 4-202628

Patent Document 6: Japanese Patent No. 4025170

SUMMARY OF INVENTION

It is an object of the present invention to improve the acid resistance of a high-Si austenitic stainless steel and provide an austenitic stainless steel having an excellent corrosion resistance.

As a result of investigating the reasons why the acid resistance of a high-Si austenitic steel is unstable, the present inventors have obtained the following findings.

In high-temperature and concentrated nitric acid, as well known, the steel surface sustains transpassive corrosion so that $Cr_2O_3$ in the passive film is eluted, thus causing elution of the base material. With Si contained in steel, Si which is once eluted into a solution is oxidized to reprecipitate as $SiO_2$ on the steel surface and forms a silicate film, thereby exhibiting nitric acid corrosion resistance.

In this case, if inclusions which are hard to be deformed by rolling ($B_1$ type inclusions to be described later) like $Al_2O_3$ are present in steel, as a result of the elution of the passive film of $Cr_2O_3$ and the base material due to transpassive corrosion, the inclusions are exposed on the steel surface. Thus exposed inclusions include grains each one of which has a size of not less than several micro meters which is much larger compared with the thickness of the silicate film (several tens of nm). Since the affinity between those inclusions and $SiO_2$ is small, a sufficient formation of silicate film will occur neither on the surface of the inclusions, nor on the boundaries thereof. For that reason, a gap is inevitably formed between an inclusion and a silicate film and crevice corrosion locally occurs so that corrosion will progress excessively.

JIS G 0555 (2003) Annex 1 "Microscopic Testing for the Non-Metallic Inclusions on the Point Counting Principle" (hereafter, simply referred to as the method according to JIS G 0555) specifies a microscopic testing method for non-metallic inclusions of steel. Inclusions are classified into A type inclusions which are those that have undergone viscous deformation through working such as hot rolling (the A type being subdivided into $A_1$ type which is a type of sulfides and $A_2$ type which is a type of silicates), B type inclusions which are those that have a form of granules lined up collectively and discontinuously in the working direction (the B type being subdivided into $B_1$ type which is a type of oxides such as alumina and $B_2$ type which is a type of carbonitrides), and C type inclusions such as CaO, which are those irregularly dispersed without plastic deformation.

Although $B_1$ type inclusions such as alumina are generated through the oxidation of Al, since the melting point thereof is high, they will not be fused even during molten steel refining and remain in a solid state. These grains adhere to each other and aggregate upon collision therebetween during molten steel treatment, thus growing in a cluster form. Since individual grains are not extensible at the room temperature and in a hot-rolling temperature range, they remain in a small granular form, and are present discontinuously in a hot-rolled steel sheet as granular grains having a size of one to several micro meters. As a result of that, the above described problem occurs.

While carbonitrides of Nb, Ti, Zr, and the like are classified into $B_2$ type inclusions, since they dissolve into a high-temperature and concentrated nitric acid solution, the above described problem will not occur.

C type inclusions such as CaO are generated as a result of addition of Ca, such as Ca processing, etc. These inclusions have a relatively low melting point, and sustain eutectic reaction with other oxides, thereby being fused in a molten steel refining temperature range. During molten steel treatment, when grains collide with each other, since they both exist as liquid, they grow by increasing the sizes of grains so that the size of one grain becomes not less than several micro meters. While these grains solidify in a hot-rolling temperature range or at temperatures lower than that, and exist as a solid, since they are not extensible, they continue to exist in a rolled steel sheet as granular grains. However, since the CaO inclusions which are exposed to the outer layer dissolve in a high-temperature and concentrated nitric acid solution, the above described problem will not occur.

Since A type inclusions such as $SiO_2$ have a relatively low melting point as with C type inclusions, they grow into a size of not less than several micro meters as a result of colliding with each other in a liquid state during molten steel treatment. However, since A type inclusions have extensibility, they are extended along with the base material, in hot rolling or cold rolling, into a thickness of, although dependent on the reduction ratio, not more than 1 micro meter. Among extended inclusions, $A_2$ type inclusions themselves serve as a substitute for a passive film, thereby improving nitric acid corrosion resistance. Moreover, in the case of $SiO_2$, since it has affinity with a silicate film which is formed from eluted Si, it will not hinder the formation of a silicate film even if exposed on the surface of steel.

As described above, it has been found that major inclusions which affect the corrosion resistance in high-temperature and concentrated nitric acid are $B_1$ type inclusions such as alumina, and therefore the amount thereof needs to be controlled. Further, $SiO_2$ which is an $A_2$ type inclusion is preferably contained in high-Si austenitic stainless steel provided that the amount thereof is within a certain limitation, since $SiO_2$ is effective to improve nitric acid corrosion resistance.

The present invention is a austenitic stainless steel having a chemical composition comprising: C: at most 0.04%; Si: 2.5-7.0%; Mn: at most 10%; P at most 0.03%; S: at most 0.03%; N: at most 0.035%; sol. Al: at most 0.03%; Cr: 7-20%; Ni: 10-22%; optionally, one or more types selected from Nb, Ti, Ta and Zr: 0.05-0.7% in total; and the balance being Fe and impurities, wherein a total amount of $B_1$ type inclusions measured by a method according to JIS G0555 is 0.03% or less by area %.

The austenitic stainless steel relating to the present invention preferably contains at most 0.06% of $SiO_2$ which is a $A_2$ type inclusion measured by a method according to JIS G 0555.

The high-Si austenitic stainless steel relating to the present invention has stabilized acid resistance, and exhibits excellent corrosion resistance in a high-temperature and concentrated nitric acid environment. Therefore, this stainless steel is suitable for a construction material of a nitric acid production plant and is also usable for applications where acid resistance is required.

BRIEF DESCRIPTION OF DRAWINGS

FIG. 1 is a graph showing an example of the relationship between $B_1$ type inclusions and a corrosion rate.

DESCRIPTION OF EMBODIMENTS

The present invention relating to a high-Si austenitic stainless steel will be explained in greater detail while referring to the attached drawings. As described above, "%" relating to the chemical composition of steel means mass %.

[Chemical Composition of Steel]

[Chemical Composition]

[C: at Most 0.04%]

Although C is an element to increase the strength of steel, it deteriorates corrosion resistance by forming Cr carbides at grain boundaries in a heat-affected zone of a welded part, and by causing sensitization (increasing susceptibility to intergranular corrosion), among other reasons. Therefore, the C content shall be at most 0.04%. The C content is preferably at most 0.03% or less, and more preferably at most 0.02%.

[Si: 2.5 to 7.0%]

Si shall be contained in an amount of at least 2.5% and at most 7% to improve the corrosion resistance in concentrated nitric acid. To form a silicate film for ensuring corrosion resistance in nitric acid, the Si content shall be at least 2.5%. On the other hand, when Si is excessively contained, a zero ductility temperature of stainless steel declines and hot rolling thereof becomes difficult, thereby leading to a deterioration in hot workability, and leading to not only increase of cost but also deterioration of weldability. Therefore, the upper limit of the Si content shall be 7%. The lower limit of the Si content is preferably 2.7%, and more preferably 2.8%. Moreover, the upper limit of the Si content is preferably 6.8%, and more preferably 6.6%.

[Mn: at Most 10%]

Since manganese (Mn) is a stabilizing element of austenite phase and also acts as a deoxidizer, it is contained in an amount of at most 10%. A Mn content exceeding 10% will lead to deterioration of corrosion resistance, hot cracking during welding, and further deterioration of workability. The Mn content is preferably at most 5%, and more preferably at most 2%. To reliably achieve the above described effects of Mn, the Mn content is preferably at least 0.5%, and more preferably at least 1.0%.

[P: at Most 0.03%, S: at Most 0.03%]

Both elements P and S are adverse to corrosion resistance and weldability, and S is an element particularly adverse to hot workability so that the contents thereof are preferably as low as possible, and adverse effects of each of them will become noticeable when the content thereof exceeds 0.03%. Therefore, the P content shall be at most 0.03%, and the S content shall be at most 0.03%.

[N: at Most 0.035%]

Since N has a strong affinity with Nb, Ti, Ta, and Zr, and hinders immobilizing C by these elements, the content is preferably as low as possible. When the N content exceeds 0.035%, its adverse effect will become noticeable. Therefore, the N content shall be at most 0.035%. The N content is preferably at most 0.020%, and more preferably at most 0.015%.

[Sol. Al: at Most 0.03%]

Besides that Al is used as a deoxidizer and reducer of slag, Al is mixed into steel during the addition of alloys since it is contained in those alloys. Al interacts with dissolved oxygen in molten steel to form $Al_2O_3$. In addition, $Al_2O_3$ is also formed as a result of $SiO_2$ inclusions in molten steel and oxides in slag being reduced by Al.

As described above, $Al_2O_3$ inclusions exposed on the outer layer are water insoluble, and hinder the formation of a silicate film which is necessary for corrosion resistance in nitric acid, causing crevice corrosion. In addition, they also cause nozzle clogging during casting, appearance failure, and a fracture flaw which becomes starting points of cracking and corrosion. Therefore, in the present invention, the amount of $B_1$ type inclusions whose principal component is $Al_2O_3$ inclusion is controlled to be less than a particular amount. Therefore, the sol. Al content shall be at most 0.03%. The sol. Al content is preferably at most 0.02%. Reduction of Al content can be achieved by, for example, using an alloy of a low Al content.

[Cr: 7 to 20%]

Cr is a key element to improve the corrosion resistance of stainless steel and the content shall be 7 to 20%. When the Cr content is less than 7%, adequate corrosion resistance cannot be obtained. On the other hand, when the Cr content is excessive, a two-phase structure in which a large amount of ferrite has precipitated due to the coexistence of Si and Nb occurs, causing deterioration of workability and impact resistance; therefore, the upper limit of the Cr content shall be 20%. The lower limit of the Cr content is preferably 10%, and more preferably 15%.

[Ni: 10 to 22%]

Since Ni is an element to stably obtain an austenite phase and has an effect of increasing the zero ductility temperature, it shall be contained in an amount of 10 to 22%. When the Ni content is less than 10%, it is not adequate to obtain an austenite single phase. Excessive addition of Ni merely causes an increase of cost, and the content of at most 22% is adequate to obtain an austenite single phase. The upper limit of the Ni content is preferably 18%, and more preferably 14%. The lower limit of the Ni content is preferably 11%, and more preferably 12%.

[One or More Types of Nb, Ti, Ta, and Zr: 0.05 to 0.7% in Total]

Since any of Nb, Ti, Ta, and Zr effectively immobilize C and suppressing the deterioration of corrosion resistance due to sensitization, and is also an element which is effective in particularly suppressing the sensitization of a welded heat affected zone, they are optional elements which may be contained as necessary. For the suppression of sensitization, it is effective that the total content of one or more types of these elements is at least 0.05%. Moreover, a total content of one or more types of these elements exceeding 0.7% will deteriorate the workability and corrosion resistance. Therefore, when one or more types selected from Nb, Ti, Ta, and Zr are contained, the total content thereof shall be 0.05% to 0.7%. The lower limit of the total content is preferably 0.3%.

The remainder other than the above-described elements is Fe and impurities.

[Inclusions]

Any of the amounts of inclusions in the present invention represents an amount measured by the method according to JIS G 0555. Moreover, any of the amounts (%) of inclusions is represented in area %. The measurement is conducted according to the method specified by the above described standard in such a way that 60 visual fields are measured and an average value thereof is taken as an amount of inclusions.

[Total Amount of $B_1$ Type Inclusions: at Most 0.03%]

In the case of a high-Si austenitic stainless steel relating to the present invention, most of $B_1$ type inclusions are alumina ($Al_2O_3$) in terms of the chemical composition. The $Al_2O_3$ inclusions which are exposed on the outer layer of steel are water insoluble, and hinder the formation of a silicate film which exhibits corrosion resistance in nitric acid, thereby causing crevice corrosion. Besides that, the $Al_2O_3$ inclusions in molten steel will cause nozzle clogging and deterioration of casting work. Moreover, inclusions that have remained in a cast slab become flaws as a result of rolling, and they not only degrade appearance but also become starting points of cracking during working and usage so that a process to remove the flaws becomes necessary. Therefore, to improve these, the amount of $B_1$ type inclusions shall be at most 0.03%. This amount is preferably at most 0.025%.

[Amount of $SiO_2$ of $A_2$ Type Inclusions: at Most 0.06%]

Since, as described above, $A_2$ type inclusions such as $SiO_2$ have a relatively low melting point as with C type inclusions, they grow into a size of not less than several micro meters during molten steel treatment. However, since they have extensibility, they are extended along with the base material in hot rolling or cold rolling into a thickness of, although dependent on the reduction ratio, not more than 1 micro meter. Moreover, $A_2$ type inclusions such as $SiO_2$ which are present in a steel sheet are very thin and act as a substitute for a passive film. However, when $SiO_2$ of A type$_2$ inclusions is present exceeding 0.06%, it has adverse effects on workability as with $B_1$ type inclusions.

From what has been described above, since the presence of $SiO_2$ which is a $A_2$ type inclusion in amount of at most 0.06% adequately ensures nitric acid corrosion resistance, this inclusion is preferably contained in an amount of at most 0.06%. The content of this inclusion is preferably at least 0.001% and at most 0.06%.

A method of identifying $SiO_2$ which is a $A_2$ type inclusion includes determination by visual inspection. While sulfide inclusions which are $A_1$ type inclusions have a thin color, since the $SiO_2$ inclusion has a dark black color, it is possible to identify the $SiO_2$ inclusion by visual inspection.

It is noted that among inclusions which are classified into C type inclusions are those which may form a complex oxide or mixed oxide with $SiO_2$, CaO, etc. when concentration of Al in molten steel becomes high. The appearance of these mixed oxides is not very different from that of the C type inclusions which are dominantly made up of CaO etc., and it is difficult to distinguish them without conducting elementary analysis. While the crystal structures of these oxides are unknown, they dissolve in a high-temperature and concentrated nitric acid solution and only $SiO_2$ will remain. This inclusion has a size of not less than 10 μm, and cavities are formed in a high-temperature and concentrated nitric acid solution so that crevice corrosion progresses, thereby deteriorating corrosion resistance.

Therefore, although it is preferable to limit the amounts of these complex/mixed oxides as well, since these types of inclusions cannot be distinguished in appearance from the C type inclusions which are dominantly made up of CaO etc., and the aforementioned complex/mixed inclusions increase as $B_1$ type inclusions increase, in the present invention, effects which are aimed at are achieved by limiting the content of $B_1$ type inclusions, thereby indirectly limiting the amount of the aforementioned complex/mixed inclusions as well.

[Manufacturing Method]

Next, a method for reliably manufacturing a high-Si austenitic stainless steel relating to the present invention will be described. However, it is possible to adopt other manufacturing methods provided that a stainless steel relating to the present invention identified by the above described chemical composition and inclusions can be manufactured.

$Al_2O_3$ in molten steel is formed by addition of Al under the presence of dissolved oxygen as shown in Formula (1).

$$2Al+3O \rightarrow Al_2O_3 \quad (1)$$

Moreover, when Al is charged in a state where inclusions of oxides formed of an element having a weaker oxidizing power compared with Al, the oxides are reduced by Al to form $Al_2O_3$ as shown in Formula (2).

$$2Al+3MxO \rightarrow 3xM+Al_2O_3 \quad (2)$$

In the case of a high-Si steel, a large amount of $SiO_2$ inclusions are formed as a result of charging a large amount of Si. When Al is charged thereinto, the reduction reaction by Al shown in Formula (2) occurs, leading to the reaction shown by Formula (3).

$$4Al+3SiO_2 \rightarrow 3Si+2Al_2O_3 \quad (3)$$

For this reason, in a high-Si steel, the formation of $Al_2O_3$ inclusions by the reaction of the above described Formula (3) is suppressed by causing $SiO_2$ to remain in steel after charging a large amount of Si, and controlling the amount of Al. Although this method can suppress to some extent, the formation of $Al_2O_3$ inclusions, it is not adequate to achieve a desired corrosion resistance. Therefore, in addition to the limitation of the amount of Al, it is necessary to limit the amount of $Al_2O_3$ inclusions and, for that purpose, it becomes necessary to perform floatation separation of inclusions.

To suppress the formation of $Al_2O_3$ inclusions by the reaction of the above described Formula (3), it is necessary not only to control the amount of Al to be charged or obviates the charging, but also to select and use alloys having a lower Al content since Al is contained in Si alloys etc. which are used as a Si source.

Preferable conditions in a steel refining step when manufacturing a high-Si austenitic stainless steel relating to the present invention will be shown below.

First, scrap and alloys are melted in an electric furnace; raw materials are carefully selected to use the materials having as low concentration of Al as possible. Attention shall be paid to that Al is not mixed into scrap.

Thereafter, as a refining step, decarburization process is performed first in an AOD (argon oxygen decarburization) furnace and next in a VOD (vacuum oxygen decarburization) furnace.

In the decarburization by AOD, oxygen gas is used to remove C in molten steel to outside the system as CO gas. At that moment, while oxidation of Cr also progresses simultaneously, decarburization is performed while suppressing the oxidation of Cr by reducing the partial pressure of CO gas through mixing of argon gas.

Nevertheless, a part of Cr is oxidized and moves into slag as $Cr_2O_3$. Since Cr is an expensive element, it is reduced into molten steel by using a reducer after the process is finished. Generally, reduction is performed by using Al or an Fe—Si alloy as a reducer. However, in the case of the present invention, to suppress the formation of alumina inclusions which deteriorate corrosion resistance in high-temperature and concentrated nitric acid, it is necessary to limit the charging of Al. Accordingly, in AOD, Al is not used during reduction, and only an Fe—Si alloy is used to perform reduction.

As the Fe—Si alloy to be used here, an alloy having as low an Al content as possible is used. In a generally used low-cost Fe—Si alloy, about 1% of Al, which is used in the production process of the alloy, is mixed. However, to achieve the level of $B_1$ type inclusions identified by the present invention, although the cost of Fe—Si alloy becomes about twice as high, an expensive low-Al Fe—Si alloy having an Al content of about 0.1% is used.

Further, alumina is contained in the slag after reduction. To avoid that the alumina in this slag is reduced in the subsequent steps and is introduced into steel as Al, and the Al reduces the $SiO_2$ type inclusions etc. to form $Al_2O_3$ type inclusions, alumina in the slag is physically removed to outside the system by carefully performing slag removal after the reduction is finished in AOD.

After the reduction in AOD, in a normal operation, the formed slag is removed until about 70% of the metal outer layer appears to the outside so that the slag is remained on about 30% of the metal outer layer. This is for the purpose of preventing the decline of the yield due to the loss of the metal which is discharged to outside the system with the slag. However, in the present invention, to avoid that alumina in the slag is reduced into molten steel as Al, and this Al interacts with $SiO_2$ type inclusions to form $Al_2O_3$ type inclusions, slag removal is thoroughly performed until at least 90% of the metal appears on the outer layer.

Thereafter, through VOD, to further remove C to outside the system, oxygen gas is used to remove C in molten steel to outside the system as CO gas. Decarburization is performed while suppressing the oxidization of Cr by evacuating the system and reducing pressure to lower the partial pressure of CO gas. Thereafter, an Fe—Si alloy is charged for the purposes of reducing Cr oxides which have been oxidized and separated into the slag and, at the same time, adding Si to a predetermined value to ensure corrosion resistance in high-temperature and concentrated nitric acid. At this time as well, it is necessary to use a low-Al Fe—Si alloy. By using a low-Al Fe—Si alloy, the Al value becomes not more than a specified value.

After the VOD processing, the final composition and the molten steel temperature are adjusted in a ladle. During this ladle refining, a low-Al Fe—Si alloy is also charged to adjust to desired component values. At that time, alumina which remains, though in a small amount, in the slag is reduced by Fe—Si alloy to dissolve into steel as Al, and thereafter the Al is reoxydized by reducing inclusions such as $SiO_2$ and the slag, thus resulting in the formation of $Al_2O_3$. To prevent that, slag cutting is performed by using a snorkel and care is taken such that the Fe—Si alloy being charged will not be in direct contact with the slag. The Si concentration in the Fe—Si alloy is ten times or more as high as that in molten steel, and therefore the reducing power of Si is higher in the alloy. The $Al_2O_3$ in the slag, which will not be reduced by Si which is present in molten steel by an amount of about 2.5 to 7%, will be reduced by the Fe—Si alloy containing Si by an amount of several tens of percent. The reduced Al will be reoxydized by the slag and inclusions, causing harmful $Al_2O_3$ type inclusions to be formed. Therefore, to prevent such reoxydization, it is effective to avoid a direct contact with the slag when the Fe—Si alloy is charged.

Thereafter, casting is performed by use of a CC (continuous casting facility). It is effective for reducing alumina inclusions to facilitate the floatation of inclusions by increasing the time period from the end of ladle refining to the start of casting, and facilitate floatation separation of inclusions through aggregation and coarsening of inclusions etc. by reducing the casting rate and exploiting electromagnetic stirring.

This production method provides a high-Si austenitic stainless steel relating to the present invention in which sol. Al and $B_1$ type inclusions are reduced to a level which has never existed so far: sol. Al: 0.03% or less and the total of $B_1$ type inclusions: at most 0.03%, and which exhibits stable acid resistance and excellent corrosion resistance in high-temperature and concentrated nitric acid.

EXAMPLES

Next, the present invention will be described further in detail with reference to Examples.

From molten steel having the composition shown in Table 1, a slab having a thickness of 200 mm was produced through an electric furnace—AOD—VOD—ladle refining—continuous casting processes, and the cast slab was cut into a predetermined size and processed into a sheet of 6 mm thickness by hot rolling. The major production conditions in that occasion were as shown in Table 1. Thus manufactured Steel Sheets 1 to 12 were subjected to pickling to remove the scale on the surfaces thereof, and thereafter were subjected to a corrosion test.

The corrosion test was conducted by dipping in concentrated nitric acid of a temperature of 60° C. and a concentration of 98% for 700 hours. Corrosion rates calculated from the masses of a test piece before and after the dipping are listed in Table 1 along with the amounts of $B_1$ type inclusions and $A_2$ type inclusions of Test steels which were determined by the above described method. It is noted that as $A_2$ type inclusions, the amount of $SiO_2$ inclusion was measured by the above described method by visual inspection.

Test steels 1 to 3, which were inventive examples, showed corrosion rates of less than 0.1 $g/m^2 \cdot hr$, which were excellent results.

Referring to comparative examples, Test steel 4 showed a large corrosion rate since the sol. Al content exceeded the upper limit thereof and the amount of $B_1$ type inclusions also exceeded the upper limit thereof as a result of using an ordinary Fe—Si alloy.

Test steel 5, in which Cr content deviated from the lower limit value thereof according to the present invention, showed a very large corrosion rate.

Test steel 6 had a Si content which deviated from the lower limit value thereof according to the present invention. Although pick-up of Al was small despite that an ordinary Fe—Si alloy was used, the corrosion rate was extremely large because of a low Si content.

Test steel 7 showed a large corrosion rate because the N content deviated from the upper limit value thereof.

Test steel 8 was an example where slag removal after AOD was insufficient. The alumina in the slag was partly reduced in the next step and as a result of Al pick-up, the sol. Al in molten steel deviated from the upper limit value thereof according to the present invention. And since the amount of $B_1$ type inclusions also deviated from the upper limit value thereof accordingly, the corrosion rate was large.

TABLE 1

| Test steel | Chemical Composition of Steel (mass %, the remainder being Fe and impurities) | | | | | | | | | | Manufacturing conditions: Al grade in Fe—Si alloy | Manufacturing conditions: After AOD Metal outer layer exposure after slag removal |
|---|---|---|---|---|---|---|---|---|---|---|---|---|
| No. | C | Si | Mn | P | S | Cr | Ni | Al | Nb | N | | |
| 1 | 0.015 | 4.25 | 1.05 | 0.023 | 0.008 | 17.05 | 13.88 | 0.012 | 0.48 | 0.013 | 0.10% | >90% |
| 2 | 0.016 | 6.5 | 0.98 | 0.014 | 0.012 | 16.94 | 13.87 | 0.006 | 0.45 | 0.009 | 0.10% | >90% |
| 3 | 0.030 | 2.82 | 0.88 | 0.019 | 0.006 | 19.31 | 13.81 | 0.010 | 0.55 | 0.014 | 0.10% | >90% |
| 4 | 0.025 | 4.22 | 1.23 | 0.024 | 0.009 | 16.88 | 13.97 | 0.048 | 0.50 | 0.009 | 1% | >90% |
| 5 | 0.022 | 4.37 | 1.03 | 0.016 | 0.018 | 5.55 | 13.99 | 0.012 | 0.41 | 0.017 | 0.10% | >90% |
| 6 | 0.019 | 1.02 | 1.13 | 0.016 | 0.008 | 19.54 | 13.93 | 0.025 | 0.60 | 0.028 | 1% | >90% |
| 7 | 0.024 | 4.88 | 1.55 | 0.022 | 0.014 | 19.01 | 13.88 | 0.020 | 0.40 | 0.045 | 0.10% | >90% |
| 8 | 0.017 | 4.56 | 1.25 | 0.022 | 0.005 | 18.08 | 14.06 | 0.035 | 0.41 | 0.010 | 0.10% | 70% |
| 9 | 0.020 | 3.98 | 1.07 | 0.021 | 0.005 | 16.50 | 13.86 | 0.041 | 0.46 | 0.013 | 0.10% | >90% |
| 10 | 0.023 | 4.38 | 1.01 | 0.015 | 0.017 | 16.90 | 13.80 | 0.011 | 0.45 | 0.011 | 0.10% | >90% |
| 11 | 0.019 | 4.95 | 1.06 | 0.025 | 0.008 | 16.72 | 13.76 | 0.008 | 0.51 | 0.019 | 0.10% | >90% |
| 12 | 0.018 | 4.33 | 0.96 | 0.020 | 0.015 | 17.02 | 13.97 | 0.006 | 0.50 | 0.014 | 0.10% | >90% |

| Test steel No. | Use of snorkel | Manufacturing conditions: Ladle refining: Time period from end of refining to start of casting | Manufacturing conditions: CC: Withdrawal rate m/min | Inclusions: $B_1$ type % | Inclusions: $A_2$ type % | Corrosion rate in 60° C., 98% nitric acid $g/m^2 \cdot hr$ | |
|---|---|---|---|---|---|---|---|
| 1 | YES | 28 min | 0.5 | 0.013 | 0.004 | 0.036 | Inventive |
| 2 | YES | 25 min | 0.5 | 0.020 | 0.025 | 0.052 | |
| 3 | YES | 26 min | 0.5 | 0.025 | 0.048 | 0.045 | |
| 4 | YES | 25 min | 0.5 | 0.035 | 0.020 | 0.189 | Comparative |
| 5 | YES | 28 min | 0.5 | 0.025 | 0.020 | 0.785 | |
| 6 | YES | 27 min | 0.5 | 0.020 | 0.012 | 1.480 | |
| 7 | YES | 25 min | 0.5 | 0.025 | 0.012 | 0.153 | |
| 8 | YES | 26 min | 0.5 | 0.035 | 0.040 | 0.177 | |
| 9 | NO | 27 min | 0.5 | 0.035 | 0.032 | 0.201 | |
| 10 | YES | 7 min | 0.5 | 0.040 | 0.040 | 0.192 | |
| 11 | YES | 25 min | 0.8 | 0.040 | 0.044 | 0.210 | |
| 12 | NO | 8 min | 0.5 | 0.028 | 0.064 | 0.205 | |

(Remarks)
Underlines indicate conditions out of the scope of the present invetnion FIG. 1 shows in a graph an example of the relationship between the amount of $B_1$ type inclusions and the corrosion rate. It is noted that Test steels 5, 6, 7, and 12 are not plotted.

In Test steel 9, since snorkel was not used at the time of final composition adjustment in the ladle refining, alumina in the slag was reduced by concentrated Si in the Fe—Si alloy which was charged, and the sol. Al content in molten steel deviated from the upper limit value thereof. Since, as a result of that, $B_1$ type inclusions also deviated from the upper limit value thereof, the corrosion rate was large.

In Test steel 10, the time period from the end of ladle refining to the start of casting was short, and floatation separation of inclusions was insufficient. For that reason, the amount of $B_1$ type inclusions deviated from the upper limit value thereof, resulting in a large corrosion rate.

In Test steel 11, since the casting rate was fast, the floatation separation of inclusions became insufficient and the amount of $B_1$ type inclusions deviated from the upper limit value thereof according to the present invention. For that reason, the corrosion rate was large.

In Test steel 12, the time period from the end of ladle refining to the start of casting was short, and floatation separation of inclusions was insufficient. Although the amount of $B_1$ type inclusions was not more than the upper limit value thereof since the sol. Al content was sufficiently small, the amount of $A_2$ type inclusions deviated from the upper limit thereof. For that reason, the corrosion rate was large.

The invention claimed is:

1. An austenitic stainless steel characterized by having a chemical composition comprising: in mass %, C: at most 0.04%; Si: 2.5-7.0%; Mn: at most 10%; P at most 0.03%; S: at most 0.03%; N: at most 0.035%; sol. Al: at most 0.03%; Cr: 7-20%; Ni: 10-22%; one or more elements selected from Nb, Ti, Ta and Zr: 0-0.7% in total; and the remainder being Fe and impurities, wherein a total amount of $B_1$ type inclusions measured by a method according to JIS G0555 (2003) Annex 1 "Microscopic Testing for the Non-Metallic Inclusions on the Point Counting Principle" is not more than 0.03% by area %, and an amount of $SiO_2$, which is an $A_2$ type inclusion, measured by a method according to JIS G0555 (2003) Annex 1—Microscopic Testing for the Non-Metallic Inclusions on the Point Counting Principle—, is 0.001 to 0.06%.

2. The austenitic stainless steel according to claim 1, wherein the chemical composition comprises, in mass %, 0.05-0.7% in total of one or more elements selected from Nb, Ti, Ta and Zr.

* * * * *